United States Patent [19]

Hanson et al.

[11] Patent Number: 4,821,035

[45] **Date of Patent: * Apr. 11, 1989**

[54] METHOD AND APPARATUS USING A WELL CASING FOR TRANSMITTING DATA UP A WELL

[75] Inventors: Merle E. Hanson, Livermore; Paul F. Titchener, Menlo Park, both of Calif.

[73] Assignee: Comdisco Resources, Inc., San Francisco, Calif.

[ * ] Notice: The portion of the term of this patent subsequent to Oct. 14, 2003 has been disclaimed.

[21] Appl. No.: 606,473

[22] Filed: May 1, 1984

[51] Int. Cl.[4] ..... E21B 47/022; G01V 1/00

[52] U.S. Cl. ..... 340/856; 340/857; 324/355; 324/368; 324/323; 166/65.1; 166/66

[58] Field of Search ..... 73/151; 181/105; 324/347, 355, 356, 357, 368; 340/853, 854, 856, 857, 855; 367/35, 81, 911; 166/65 R, 65.1, 66

[56] References Cited

U.S. PATENT DOCUMENTS

| | | | |
|---|---|---|---|
| Re. 21,102 | 5/1939 | Jakosky | 324/356 |
| 1,804,078 | 5/1931 | Baden | 166/65 R X |
| 1,991,658 | 2/1935 | Clark et al. | 73/151 |
| 2,217,857 | 10/1940 | Byck | 166/65 R X |
| 2,225,668 | 12/1940 | Subkow et al. | 404/72 |
| 2,242,612 | 5/1941 | Leonardon | 73/154 |
| 2,310,757 | 2/1943 | Wagner | 166/65 R |
| 2,350,832 | 6/1944 | Segesman | 324/368 |
| 2,400,170 | 5/1946 | Silverman | 340/856 |
| 2,476,137 | 7/1949 | Doll | 324/368 X |
| 2,567,507 | 9/1951 | Brown | 166/66 |
| 2,826,736 | 3/1958 | Doll | 324/347 X |
| 2,955,458 | 10/1960 | Sonier et al. | 73/40.5 R |
| 3,024,658 | 3/1962 | Huddleston | 340/856 X |
| 3,057,409 | 10/1962 | Grossman | 324/368 X |
| 3,434,046 | 3/1969 | Wilson et al. | 324/221 |
| 3,437,992 | 4/1969 | Johnston | 340/856 |
| 3,454,870 | 7/1969 | Lintelman et al. | 324/347 |
| 3,478,584 | 11/1969 | Strubhar et al. | 73/155 |
| 3,568,053 | 3/1971 | Kilpatrick | 324/347 |
| 3,620,300 | 11/1971 | Crowson | 166/248 |
| 3,732,728 | 5/1973 | Fitzpatrick | 73/151 |
| 3,758,731 | 9/1973 | Vann | 166/65 R X |
| 3,900,827 | 8/1975 | Lamel | 166/113 X |
| 4,035,763 | 7/1977 | Cowles | 340/856 |
| 4,178,579 | 12/1979 | McGibbeney et al. | 340/867 |
| 4,182,159 | 1/1980 | Churchman | 73/40.5 R |
| 4,236,113 | 11/1980 | Wiley | 166/65.1 |
| 4,286,217 | 7/1981 | Planche et al. | 324/347 |
| 4,413,679 | 11/1983 | Perkins | 166/248 |
| 4,433,724 | 2/1984 | Nagano | 166/60 |
| 4,461,172 | 7/1984 | McKee et al. | 73/155 |
| 4,468,665 | 8/1984 | Thawley et al. | 340/856 |
| 4,484,627 | 11/1984 | Perkins | 166/65.1 |
| 4,522,262 | 6/1985 | Perkins | 166/248 |
| 4,553,226 | 11/1985 | Scherbatskoy | 340/853 X |
| 4,616,702 | 10/1986 | Hanson et al. | 340/856 |
| 4,724,434 | 2/1988 | Hanson et al. | 340/857 |

OTHER PUBLICATIONS

IEEE Transactions on Geoscience and Remote Sensing, vol. GE—20, No. 2, Apr. 1982, J. Bhagwan and F. N. Trofimenkoff Report On Electric Drill Stem Telemetry Method.

Oil & Gas Journal, Feb. 21, 1983, pp. 84–90.

*Primary Examiner*—Brian S. Steinberger

*Attorney, Agent, or Firm*—Christie, Parker & Hale

[57] ABSTRACT

A tool with a switch is inserted and moved down the inside of tubular-shaped and electrically conductive casing in the well. Spaced apart contacts on the tool are connected between upper and lower electrically conductive casings located on opposite sides of a high impedance separation in the casing. The switch is operated for creating a changing electrical conductance between the upper and lower casings representative of data. The electrical conductance across the high impedance separation is interrogated with an alternating current signal to retrieve the data.

44 Claims, 11 Drawing Sheets

SIGNAL SOURCE SENSOR
24
10
14a
70
20
26
26
14
16
15
21
21
21
21
28
14
16
16
18
12
14
20

METHOD AND APPARATUS USING A WELL CASING FOR TRANSMITTING DATA UP A WELL

CROSS-REFERENCE TO RELATED APPLICATIONS

This application is copending with U.S. patent applications which disclose common subject matter, as follows:

U.S patent application Ser. No. 06/606,472 entitled A TOOL AND COMBINED TOOL SUPPORT AND CASING SECTION FOR USE IN TRANSMITTING DATA UP A WELL, in the names of Paul F. Titchener, Merle E. Hanson, and Clifford W. Hamberlin, and U.S. patent application Ser. No. 06/605,832 entitled METHOD AND APPARATUS USING CASING AND TUBING FOR TRANSMITTING DATA UP A WELL, in the names of of Paul F. Titchener, Merle E. Hanson, and U.S. patent application Ser. No. 06/605,834 entitled METHOD AND APPARATUS USING CASING FOR COMBINED TRANSMISSION OF DATA UP A WELL AND FLUID FLOW IN A GEOLOGICAL FORMATION IN THE WELL, in the names of Paul F. Titchener, Merle E. Hanson, all of which were filed on even date herewith.

BACKGROUND OF THE INVENTION

1. Field of the Invention

The present invention relates to borehole telemetry systems and more specifically to method and apparatus for transmitting data up a well such as an oil or gas well.

2. Brief Description of the Prior Art

Various techniques have been used for sensing parameters, such as pressure, temperature, inclination, etc., downhole in oil and gas wells and for obtaining data about the parameters uphole.

Parameters have been sensed and recorded on strip chart recorders downhole. A problem with this technique is that the recording device must be brought back uphole to be read and, therefore, the parameter being sensed cannot be monitored uphole on a real-time basis.

Techniques have been developed for measuring parameters and transmitting data about the parameters uphole on a real-time basis. One technique is referred to as the soda straw technique in which a small tube extends down in the well casing from the top of the well to the bottom zone where pressure is sensed. An instrument is used to sense the pressure at the top of the tube which gives a measure of bottom hole pressure. Disadvantages of this technique are the high cost and time required to run in and remove the tube from the well, the danger that the tube will create problems with fracturing fluid, increased pressure required to force fluids down the casing due to the introduction of the tube, and high fluid pressure at the top of the well, creating the likelihood of a blowout. These problems are likely to occur when fracturing fluids are pumped between the casing and tubing.

Another technique is one where mud pulses are used to create data pulses in the mud being pumped downhole and the data pulses are sensed uphole. The bits of information per unit time is quite low with this technique and the devices are generally costly and mechanically complex.

Wire line techniques are used where electrical signals are transmitted uphole on a wire or electrical conductor. However, this requires a special wire extending from the surface to the bottom of the hole. Examples of such methods are described in Leonardon, U.S. Pat. No. 2,242,612, Cowles, U.S. Pat. No. 4,035,763, Wilson et al., U.S. Pat. No. 3,434,046, Planche et al., U.S. Pat. No. 4,286,217, and Jakosky, U.S. Patent Reissue No. RE. 21,102.

Other techniques are known for transmitting electrical signals to the top of the well which do not require a wire line. Examples of these techniques will now be discussed.

In an article in the *IEEE*, "Transactions on Geoscience and Remote Sensing", Vol. GE-20, No. 2, April 1982, J. Bhagwan and F. N. Trofimenkoff, report an electric drill stem telemetry method. Bhagwan et al. describe the use of a main drill stem and a downhole electrode electrically isolated from the main drill stem for transmitting data from downhole to the surface. The main drill stem and the downhole electrode comprise a portion of an electrical circuit, the balance of which includes a distant electrode placed in the earth, a conductor connecting the main drill stem to the distant electrode, and a current path through the earth between the distant electrode and the main drill stem and isolated electrode.

Two methods of telemetry are discussed. The first is a resistance change method wherein the main drill stem and the isolated downhole electrode are alternately connected and disconnected while the resultant resistance change due to the connection or disconnection is monitored at the earth's surface. In the second method, a signal from a downhole signal source is applied between the downhole electrode and the main drill stem, and received by a receiving electrode, placed between the main drill stem and the earth at the surface.

The Bhagwan article is largely theoretical in nature and is deficient in technical details. Several difficulties arise with the first or resistance method. For example, a separate drill stem is required in the cased well. Also, a bottomhole electrode, electrically separated from the drill stem, must somehow be positioned downhole but Bhagwan does not say how this would be done. Also if resistance is measured at the top of the hole using an ohm meter, ohm meters typically employ D.C. signals which would cause polarization along the drill stem. Also Bhagwan teaches that this approach would be difficult to do under field conditions that are normally encountered in drilling or testing situations.

With Bhagwan's downhole signal method, provision must be made downhole for a source of power adequate to transmit signals uphole for substantial periods of time and is not desirable for downhole equipment which must remain downhole for substantial periods of time.

Silverman, U.S. Pat. No. 2,400,170, shows a drill pipe containing an insulated section separating the main drill pipe from the drill collar and drill bit. Electrical waves are transmitted through make and break contacts from the insulated section through the surrounding earth to sensor electrodes located uphole on the surface.

Other methods of telemetry are known for producing an electrical signal downhole and radiating the signal through the earth to sensors located uphole at the surface. Such are the patents to Clark et al., U.S. Pat. No. 1,991,658 and to Subkow et al., U.S. Pat. No. 2,225,668.

Johnston, U.S. Pat. No. 3,437,992, discloses a self-contained downhole parameter signaling system of the type which generates signals downhole for transmission and detection uphole. Johnston discloses a complicated power generating system which uses the movement of a sucker rod connected to a pump and a transformer for generating electrical power downhole for the instrument package. Using the generated power, a circuit applies electrical impulses, representative of downhole parameters such as pressure or temperature, to the primary of a transformer, the secondary of which is connected between the tubing and casing. The connection to the casing is made through a sleeve, which is insulated from the tubing, and outwardly movable leaf spring contacts which engage and electrically connect to the inside of the casing. The impulses which are transferred from the primary to the secondary of the downhole transformer create electrical signals which travel up the tubing and casing to an uphole transformer. The uphole transformer amplifies the signals for conversion to usable form at the top of the well. As a result, Johnston is quite complicated.

Drilling strings are also known with nonconductive sections for electrically separating the drill string into upper and lower electrically conductive drill strings to allow the radiation of signals to the top of the well such as disclosed in *Oil & Gas Journal,* Feb. 1, 1983, pp. 84–90.

A large source of power is required to maintain both the last two mentioned downhole equipment.

SUMMARY OF THE INVENTION

The present invention involves the use of well casing for transmission of data up the well without generation of power in the casing downhole.

Briefly, a preferred method embodying the present invention is for communicating digital data up an oil or gas well. A tool with a switch is inserted in and is moved down the inside of a tubular-shaped and electrically conductive casing in the well. Spaced apart contacts on the tool are connected between upper and lower electrically conductive casings located on opposite sides of a high impedance separation in the casing. The switch is operated for changing the electrical conductance, for the flow of current, between the upper and lower casings, for causing a changing signal representative of data. The changing signal is sensed at the top of the well and a representation of the digital data is formed.

Briefly, another preferred embodiment of the invention is a digital data communication system for such an oil or gas well. An electrically conductive and annular casing is cemented in the well and the casing has a ring-shaped high impedance separation, separating the casing into an upper casing portion and a lower casing portion. Means is provided for applying an alternating current signal between the upper casing portion and the surrounding earth, causing a flow of current along the casing. A tool is insertable inside of the casing to the separation. The tool has a switch for sequentially changing the electrical conductance for such flow of current across the separation between the upper and lower casing portions, thereby causing a changing signal representative of data. The electrical conductance across the separation is determined at the upper casing portion and a representation of the data is formed.

DETAILED DESCRIPTION

Figure 1:
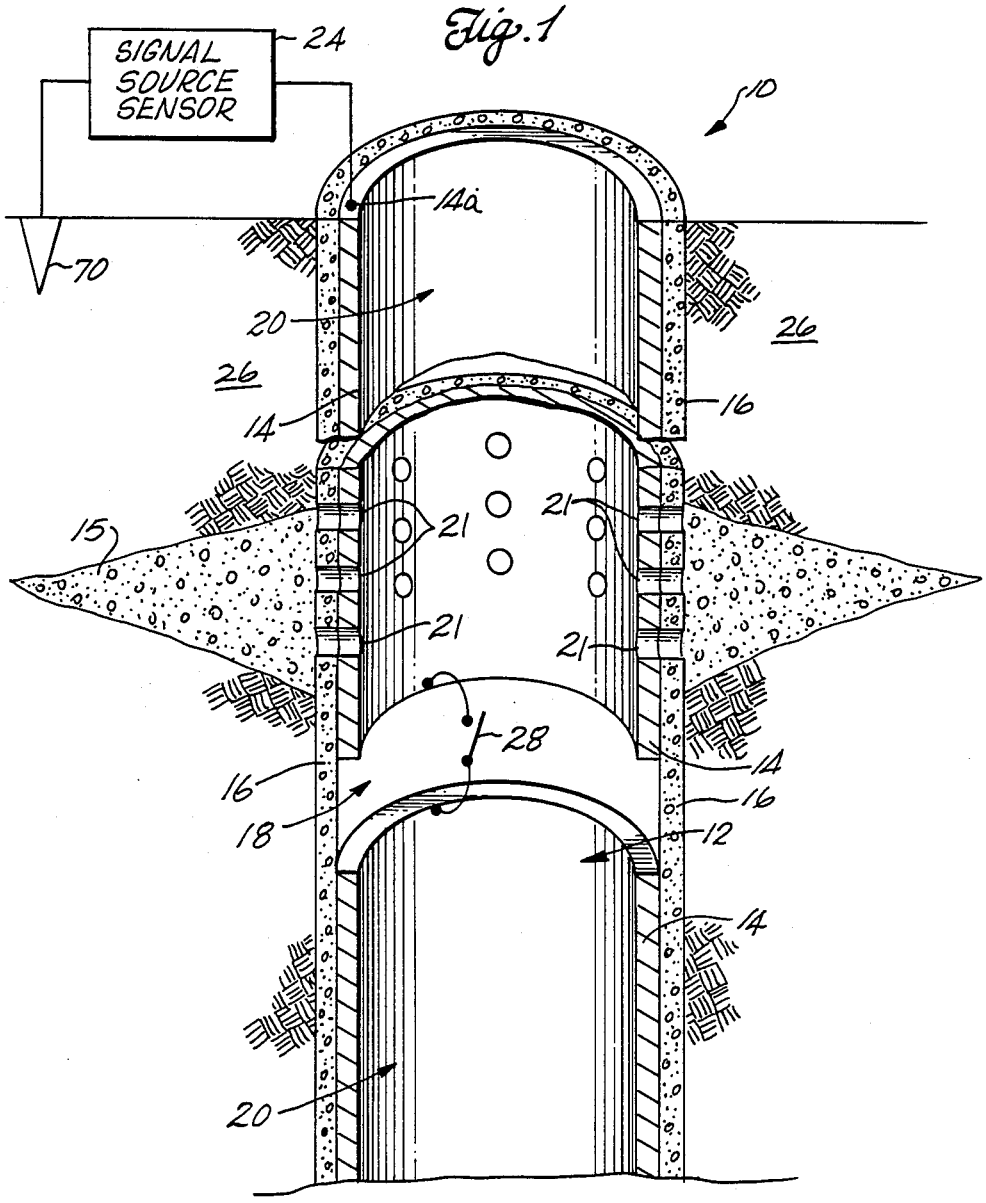
FIG. 1 is a schematic and side elevation view of a section of earth and a well casing cemented in a borehole in the earth showing an embodiment of the present invention.

Refer now to the embodiment of the invention depicted in FIG. 1. FIG. 1 depicts a digital data communication system 10 for an oil or gas well. Electrically conductive and tubular (or annular) casing 14 is cemented by cement 16 into an opening in the earth 26 as is well known in the art to form a structural wall of the well. It will be appreciated that the casing 14 is actually a string of casing with internal female threads at the upper end and male threads at the lower end of each casing section for interconnecting with the casing sections above and below.

Significantly, the casing 14 has a ring-shaped high electrical impedance separation 18 which separates the casing 14 into an upper casing portion 20 and a lower casing portion 22, called casings 20 and 22.

Signal source and sensor 24 is electrically connected between an electrode 70, sometimes referred to as a receiving electrode, and an upper end 14*a* of the upper casing 20 at the top of the well. The signal source and sensor applies an alternating current (AC) signal between the upper end 14*a* of the upper casing 20 and the surrounding earth, causing a flow of electrical current along the casing, returning through the earth to electrode 70.

To be explained in more detail, a tool (not shown in FIG. 1) is insertable inside of and movable down along the inside passage of the casing 14 to the nonconductive separation 18. The tool has a switch 28 which sequentially changes the electrical conductance across the nonconductive separation 18 between the upper and lower casings 20 and 22 and therefore causes changes in the applied signal. The pattern of opening and closing of the switch 28 is coded so as to represent digital data. The data to be represented is a parameter in the well and preferably is pressure data, although temperature or other types of data may also be represented.

The signal source and sensor 24 is also responsive to he changes in signals resulting from the applied AC signal for determining the electrical conductance across the separation 18 and for forming representations or a display of the digital data for use by operators at the top of the well. The use of AC signals as opposed to direct current signals is important since it prevents polarization.

Power sources for the AC signals are easily provided in the signal source and sensor 24. These components are located at the top of the well. The tool, including the switching means 28, can be a very low power consumption device which operates the switch 28 and other associated electronics for electrically connecting and disconnecting the upper and lower casings and hence changing resistance or conductance therebetween. This is to be contrasted with systems where AC signals are applied downhole for transmitting signals uphole which require relatively large sources of power downhole.

FIG. 1 also depicts perforations 21 through the casing 14 and cement 16. Fracturing fluid, such as fluids with chemicals and/or sand, may be applied down the interior of the casing 14 and forced out into the fracture formation 15 surrounding the perforations so as to provide a path for secondary recovery fluid, as is conventional in the oil and gas well art. During fracturing operations, it is important to monitor and get an immediate real-time indication of downhole pressure. This is easily accomplished by use of the digital data communication system depicted in FIG. 1.

Figure 2:
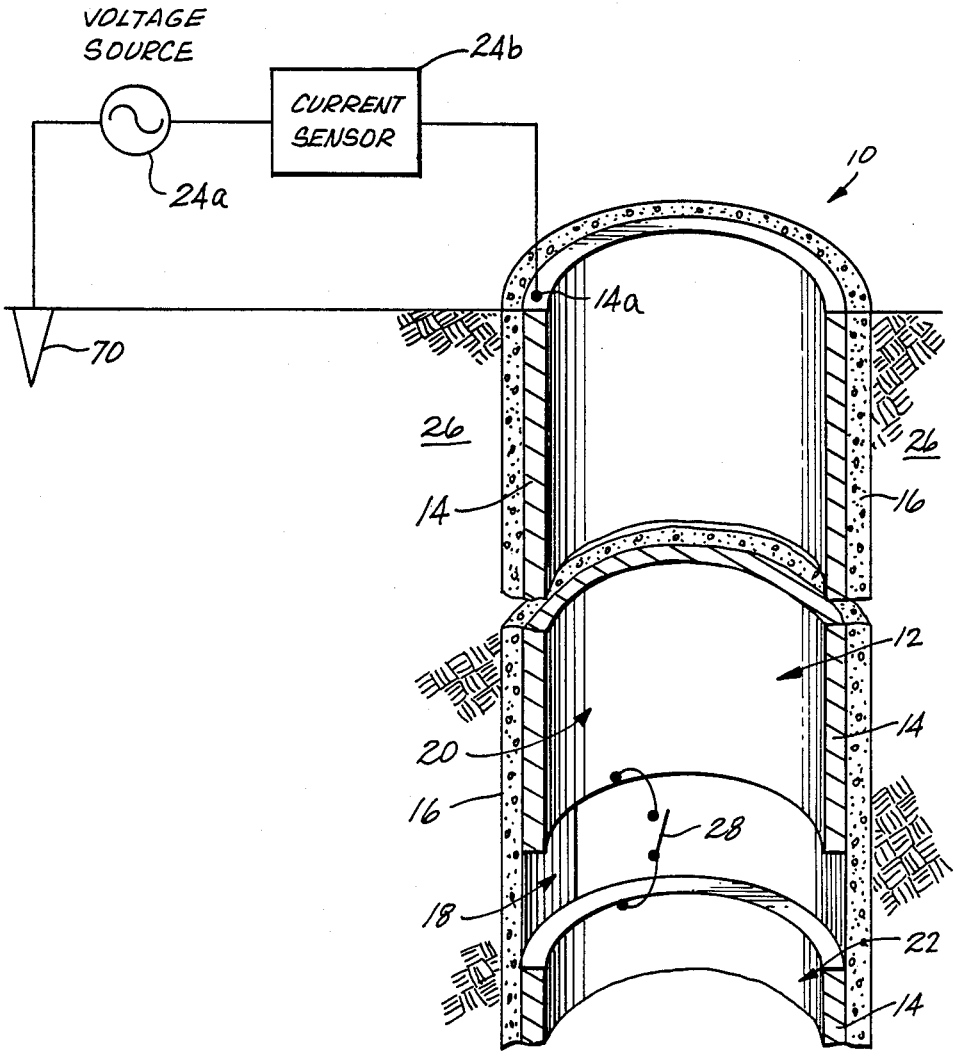
FIG. 2 is a schematic and side elevation view similar to that of FIG. 1 with the perforation and fracture area removed and depicting a constant voltage AC source and a current sensor.
Figure 3:
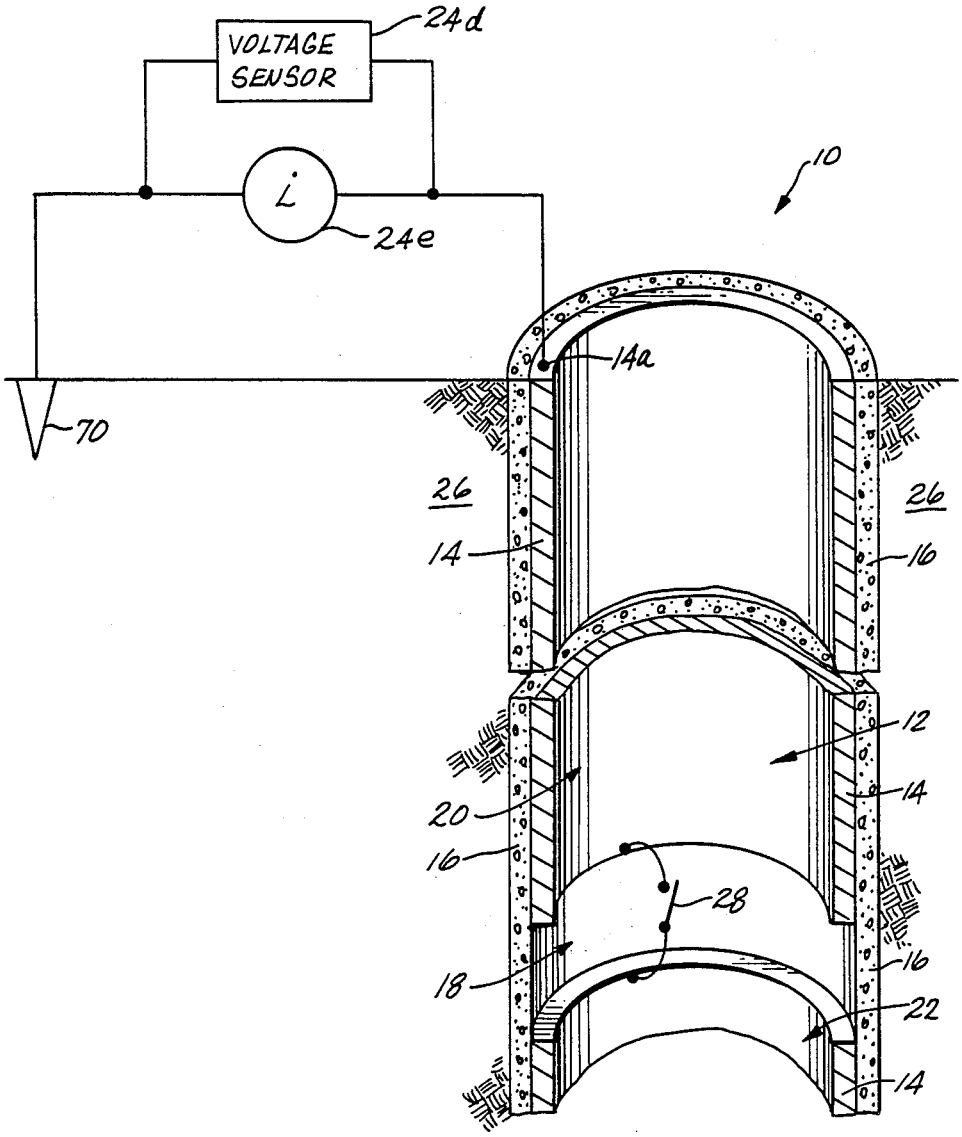
FIG. 3 is a schematic and side elevation view similar to that of FIG. 2 and depicting a constant current AC source and a voltage sensor.

The signal source and sensor 24 may be designed in a number of configurations, examples of which are depicted in FIGS. 2 and 3.

FIG. 2 schematically depicts an embodiment of the invention in which the signal source and sensor unit is a constant voltage source 24*a* for applying a constant amplitude voltage signal to the upper casing 20 and a current sensor 24*b* which senses the changes in current flowing into the upper casing portion due to the changes in the conductance created by the opening and closing of the switch 28. FIG. 2 is essentially the same as FIG. 1 except for the voltage source 24*a* and the current sensor 24*b* and except for the perforations and fracture which are not shown, for simplicity. Identical parts in FIGS. 1 and 2 are identified by the same reference numerals and a description thereof will not be repeated.

FIG. 3 depicts an alternate embodiment of the invention in which the constant current source 24*e* applies a constant current between ground, via electrode 70, and the upper end 14*a* of the upper casing 20. A voltage sensor 24*d* senses the change in voltage between the upper end 14*a* of the upper casing 20 and ground, created by the opening and closing of switch 28. FIG. 3 is essentially the same as FIG. 2 except for the current source 24*e* and the voltage sensor 24*d*. Identical parts in FIGS. 1, 2 and 3 are identified by the same reference numbers.

The path of current employed in the system of FIGS. 1, 2 and 3 is of importance and should be considered. Because of the large interface area between the upper casing 20 and the surrounding ground and between the lower casing 22 and the surrounding ground, a sufficiently low impedance path is presented, even though the cement, to allow current to flow from upper casing 20 back to the electrode 70 and from the lower casing 22 back to ground. Resistance created by the path between the upper casing 20 and electrode 70 will be of a first value when the switch 28 is open. When the switch 28 is closed, an additional, essentially parallel conductance path is provided between the lower casing 22 and the electrode 70 through ground and therefore reduces the impedance to the flow of current applied to the upper end 14*a* of the upper casing 20. Thus when constant magnitude AC voltage is applied to the upper end 14*a* of the casing 20 as in FIG. 2, different amounts of current flow through the current sensor 24*b*, depending on the conductance across the nonconductive separation 18 created by the open or closed switch 28. Similarly, when a constant amplitude AC signal is applied to the upper end 14*a* of the upper casing 20 as in FIG. 3, different magnitudes in voltage signals will appear between ground and the upper end 14*a* of casing 20, depending on the conductive condition across the nonconductive separation 18 created by the open or closed switch 28.

Figure 4:
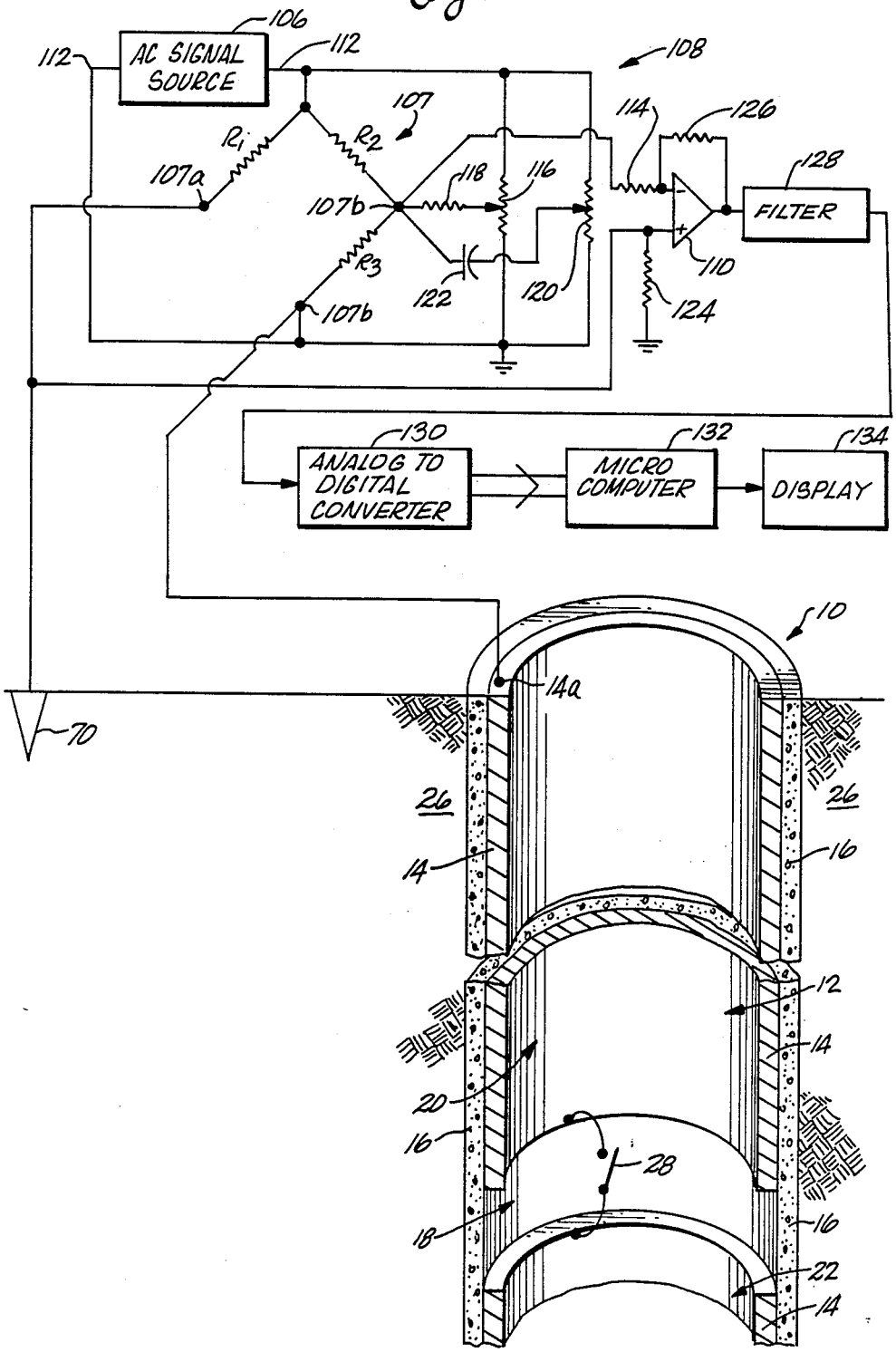
FIG. 4 is a schematic and side elevation view similar to that of FIG. 2 and depicting a preferred bridge type sensing circuit along with signal processing and display circuits.

FIG. 4 is a schematic diagram of a preferred embodiment of the invention employing a constant voltage AC signal source and a bridge type sensor. Although source 106 is preferably a constant voltage source it may be replaced with a constant current source with appropriate changes in the bridge sensing circuit as is evident to those skilled in the art.

A voltage sensor 108 has a bridge circuit 107 coupled between the electrode 70 and the upper end 14*a* of the upper casing 20. The bridge has a first resistor R1 coupled to the electrode 70 and to the noninverting input of a differential amplifier 110.

The other lead of the first resistor R1 is coupled to one side of the output from the AC signal source 106 and to a first lead of a second resistor R2. The first lead of second resistor R2 is also coupled to the first electrode of the AC signal source, and the second lead of second resistor R2 is coupled to the first lead of a third resistor R3, to the inverting input of the differential amplifier 110 through a resistor 114, to a first variable resistor 116 through a resistor 118, and to a second variable resistor 120 through a capacitor 122. The first lead of the third resistor R3 is also coupled to the inverting input of the differential amplifier 110 through resistor 114, to the variable resistor 116 through resistor 118 and to variable resistor 120 through capacitor 122. The second lead of the third resistor R3 is coupled to the upper end of the upper casing 20. A bridge is formed thereby wherein second and third resistors R2 and R3 are of the same resistive value and first resistor R1 has a different value. The casing-earth circuit in effect constitutes a fourth resistor between terminals 107*a* and 107*b* in the bridge. The second side of the output from AC signal source 106 is coupled to ground. The first lead of variable resistor 116 is coupled to the first side of the output of the AC signal source 106 and the second lead of resistor 116 is coupled to ground. The variable resistor 120 is coupled in parallel to variable resistor 116, the first lead being coupled to the first electrode 112 of the AC signal source 106, the second lead of variable resistor 120 being coupled to ground.

Variable resistor 116 is a coarse null for balancing the circuit depending on the various bulk resistances and on the particular well location. The noninverting input to the differential amplifier 110 is grounded through resistor 124. Feedback for the differential amplifier 110 to the inverting input of the differential amplifier is made through resistor 126. The output of differential amplifier 110 is coupled to a filter 128 for enhancing the signal-to-noise ratio for the detected signal. Filter 128 is preferably a bandpass filter. The bandpass is very narrow and only passes frequencies very close to the frequency of the AC signal source 106. As a result unwanted noise is filtered out.

The output of filter 128 is coupled to an analog-to-digital converter 130, the output of which is coupled to a microcomputer 132. The microcomputer 132 then provides output to a display 134, which may be a chart recorder, a digital display, a graphics display or other known display device.

The variable resistor 120 forms a phase null that nulls the phase differences in the amplitude of the voltage. Nulling can be done manually or by computer.

The AC signal source 106 is preferably a narrow band signal source, operating at a frequency of between 1 and 10 hertz and possibly as high as 100 hertz. The differential amplifier 110 raises the low voltage output from bridge 107 (across terminals 107*a* and 107*b*) which is in the range of microvolts, up to voltage in the order of 0.1 volts.

The analog-to-digital converter 130 is preferably a 16 bit converter and converts the serial analog coded information represented by the changes in voltage between terminals 107*a* and 107*b* to a parallel digital code capable of being decoded by the microcomputer 132 for outputting or storing the data. Preferably, the data communicated from downhole includes redundant bits of information to enhance the reliability of the data received. The microcomputer 132 converts the redundant coded information to an intelligible format. By manipulating the circuit, the change in conductance in the casing, as a result of the opening and closing of switch 28, of approximately 0.3% can be amplified to approximately a 10% change.

The AC signal source preferably has a frequency in the range of 1 to 10 hertz. Although frequencies as high as 100 hertz might be employed, as frequency is increased above 10 hertz, energy is dissipated into the earth in increasing amounts depending on characteristics of the earth and surrounding formations. As a result, the depth to which communication is made is reduced.

Figure 6:
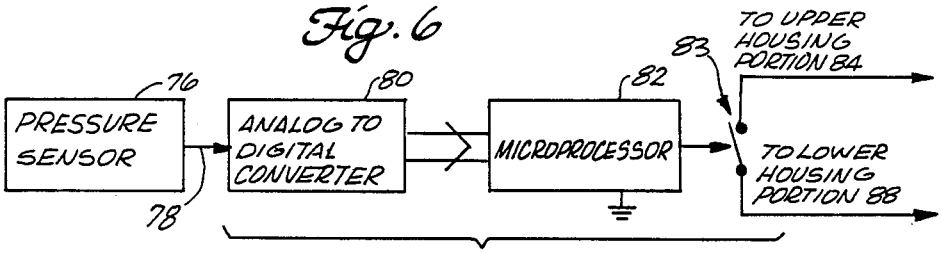
FIG. 6 is a schematic and block diagram of a pressure sensor and of the control and switch electronics.
Figure 6A:
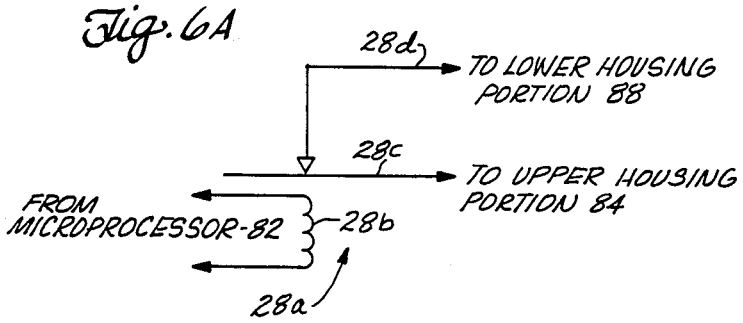
FIG. 6A is a schematic diagram of one type of switch for use in the switch electronics of FIG. 5.
Figure 6B:
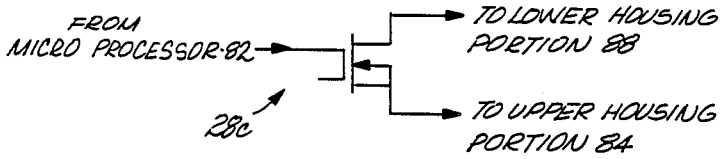
FIG. 6B is a schematic diagram of a second type of switch for use in the switch electronics of FIG. 5.
Figure 6C:
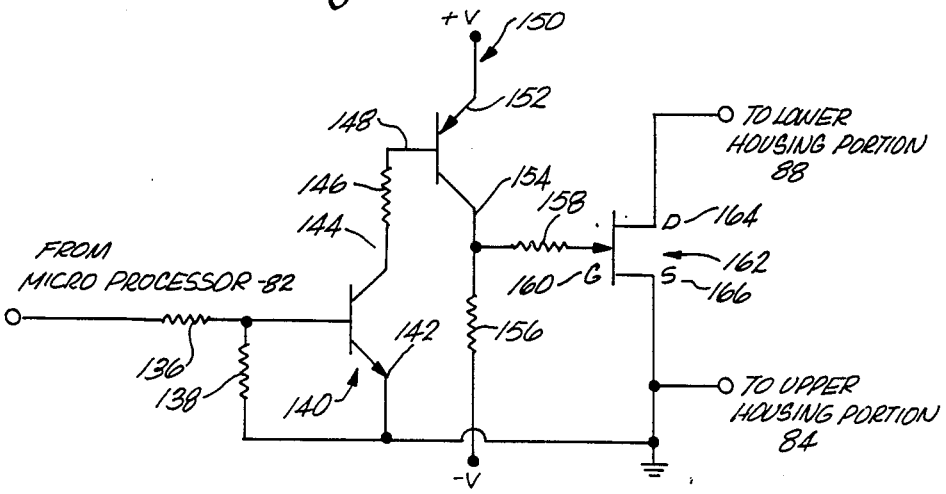
FIG. 6C is a schematic diagram of a third type of switch means for use in the switch electronics of FIG. 5.

Preferably the source of power for the switching circuit of FIG. 6C, the microprocessor, the analog-to-digital converter, and the sensor, is supplied by one or possibly two lithium battery cells, each with an output of about 1 watt of power and 3 volts. Appropriate direct current inverters and regulators are used to step up the voltage to the required levels. It is anticipated that such a battery or batteries would have about a 1-week life with the circuits disclosed in FIGS. 6 and 6C.

Figure 5:
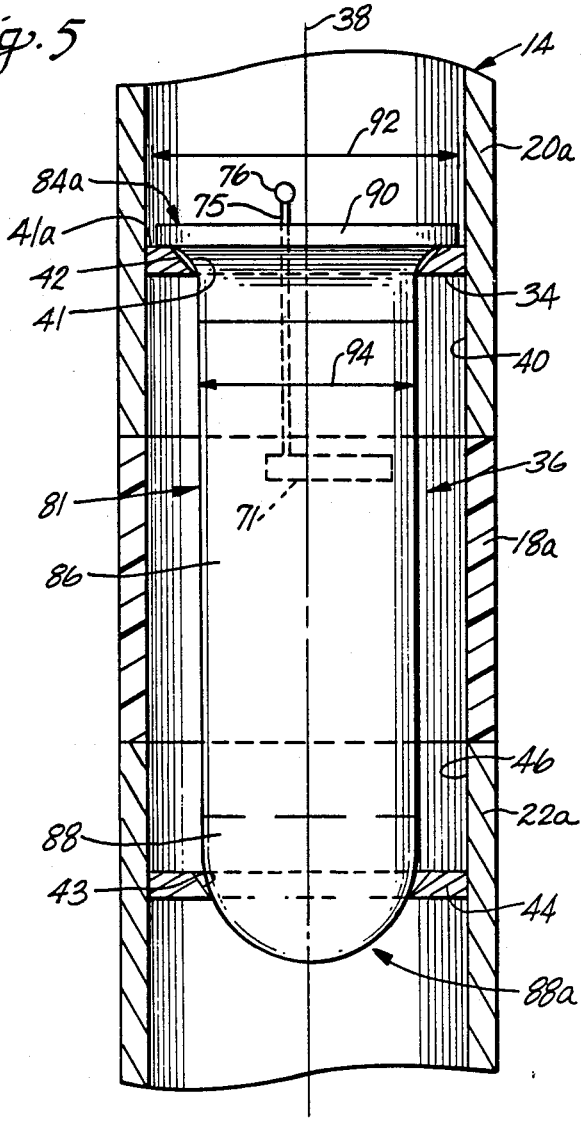
FIG. 5 is a schematic and side elevation view of a section of the well casing from the oil or gas well of FIG. 1 showing one embodiment of the tool containing the switch and one embodiment of the casing section for landing the tool, for separating the casing string into upper and lower casings about a nonconductive ring, and for contacting the tool.

Refer now to FIG. 5 and consider an example of the way in which the nonconductive ring, separating the upper casing and the lower casing, is formed and one example of the tool with the switch.

FIG. 5 depicts a tool 36 with a switch that is insertable down the casing for changing the conductance across the nonconductive ring in the casing. The tool 36 has a pressure sensor 76 mounted on a mast 75 which in turn is connected to control and switch electronics unit 71. Although preferably mounted on a mast, the sensor may be mounted flush on the top of the tool, depending on the application. The control and switch electronics unit 71 is mounted on the inside of the tool 36. Tool 36 includes a generally bullet-shaped housing 81 which is elongated between upper and lower substantially closed ends 84*a* and 88*a*, respectively. The ends are substantially closed to allow the tool to move easily down through fluid on the inside of the casing to the area where the nonconductive ring is located.

The housing 81 includes an upper or first conductive housing portion 84, a lower or second conductive housing portion 88, and a nonconductive annular-shaped housing portion 86 electrically separating the conductive housing portions 84 and 88 from each other. The end 84*a* of the housing is substantially flat which allows fluid forced down the casing string to force the tool downhole. The end 88*a* of the housing is substantially semicircular to allow the tool to easily sink down through the fluid and pass through the center of two rings (discussed below).

The control and switch electronics unit 71 includes a switch (not shown) which is adapted for alternately electrically connecting and disconnecting the upper and lower conductive housing portions 84 and 88, which are in turn respectively connected to the upper and lower casings 20*a* and 22*a* of casing 14*b* through the rings.

A tool support and casing section is provided including an electrically conductive upper ring 34 and an electrically conductive lower ring 44. The upper ring 34 is preferably made of an electrically conductive cast iron metal material and is mechanically and electrically connected to the upper casing 20*a*. The lower ring 44 is formed of the same material as and has the same characteristics as the upper ring 34 and is mechanically and electrically connected to the interior of the lower casing 22*a*. To be explained, however, the inside of the upper ring has a larger diameter than that of the lower ring. The nonconductive ring is formed in the casing by a nonconductive section of casing 18*a* which may be made from FIBERGLAS or KEVLAR (registered trademarks) or other materials which will provide the rigidity and strength required for the casing and provide good electrical isolation between the rings.

Thus the nonconductive separation may either be a physical section of casing, such as the nonconductive section of casing 18*a* or it may be a ring-shaped gap or void separating the casing into upper and lower casing sections, such as depicted in FIGS. 1–4. If the non-conductive ring is a gap, it may be formed by conventional techniques used in the well art for cutting out sections of casing.

With the arrangement depicted in FIG. 5, the nonconductive section of casing 18*a* may be used to structurally and mechanically connect the upper casing to the lower casing as described in more detail in connection with FIG. 8.

The upper ring 34 has two functions. The first function is to provide an upwardly facing shoulder 41*a* against which an outwardly extending support ring 90 on the tool 36 lands, and supports the tool with the tool extending down through the central openings of both rings 34 and 44. The second function of the ring 34 is to make good electrical contact with the upper conductive housing portion 84 and thus provide an electrical path between the upper housing portion 84 and the upper casing 20*a*. Preferably the tool seated on the upper ring acts like a plug, isolates the upper casing from the lower casing and prevents fluid flow past the upper ring and the tool down the casing. Preferably the upper ring 34 has an inclined surface 42 which faces upwardly towards the upper casing 20*a* towards a central longitudinal axis 38 of the tool and casing and engages the tapered portion of housing portion 84. With this arrangement the ring surface 42 will form a reliable electrical contact with the outer surface of the conductive housing portion 84.

The lower ring 44 preferably has a smaller diameter opening than upper ring 34 so that the tool will pass freely through the inner opening of upper ring 34 and when the tool comes to rest on the upper ring 34, the lower conductive housing portion 88 will be in mechanical and good electrical contact with the inner tapered surface 43 of the lower ring 44. Preferably the inner surface 43 of lower ring 44 also faces at an angle to the longitudinal axis 38 and towards the upper casing. As a result the somewhat sharpened lower edge of the surface 43 will actually gouge into and thereby form better electrical contact with the lower conductive housing portion 88.

The tool 36 has an upper outer perimeter, indicated by dimension lines 92, generally defined by the outer extension of support ring 90 which is of smaller diameter than the inside diameter of the passage in the casing 14*b*, thus allowing the tool to be dropped and to freely sink down through fluid in casing 14*b* to the upper ring 34. The housing 81 below the curved transistion 41 from the ring 90 has a diameter 94 which is smaller than the inside diameter of ring 34 but slightly larger than the inside diameter of ring 44. As a result the tapered lower end of tool 36, below ring 90, moves smoothly past inclined surface 42 into engagement with the inclined surface 43 of ring 44. To ensure good, tight electrical contact, pressure may be applied to fluid in the casing, forcing the tool so that the curved or tapered surface 41 engages ring 34 and the curved portion of lower housing 88 engages ring 44, forming good mechanical and electrical contact with the upper and lower rings 34 and 44.

It should be noted that the nonconductive housing portion 86 is elongated and extends at least the length of the nonconductive ring or section of casing 18*a*. This minimizes any flow of current that might otherwise pass between the outer surface of the upper conductive housing portion 84 and the lower casing 22*a* or between the lower conductive housing portion 88 and the upper casing 20*a*.

Referring to FIG. 6, the output of the pressure sensor is an analog signal representative of pressure and is coupled to the input of analog-to-digital converter 80 in electronics unit 71. The analog-to-digital converter 80 converts the analog signal to a parallel digital form which is readable by a microprocessor 82. Microprocessor 82 encodes the digital signals using classical error correcting encoding methods. The encoded digital pressure signal is then converted to a clocked serial bit stream to form control signals. The microprocessor provides the control signals to the switch 83 which causes the switch 83 to open and close in a sequence, representative of the pressure signals from pressure sensor 76. The input/output circuit of switch 83 is connected between the upper conductive housing portion 84 and the lower housing portion 88. When the microprocessor 82 opens switch 83, a high impedance or open circuit is presented both between conductive housing portions 84 and 88 and the upper and lower casings. When the microprocessor 82 closes switch 83, the conductive housing portions 84 and 88 and the upper and lower casings are electrically connected together by essentially a short circuit.

The microprocessor is programmed to form control signals for the switch in a redundant code such as Gray code so that, should errors develop in the signal sensed at the top of the well, the true pressure data can be recovered.

Figure 5A:
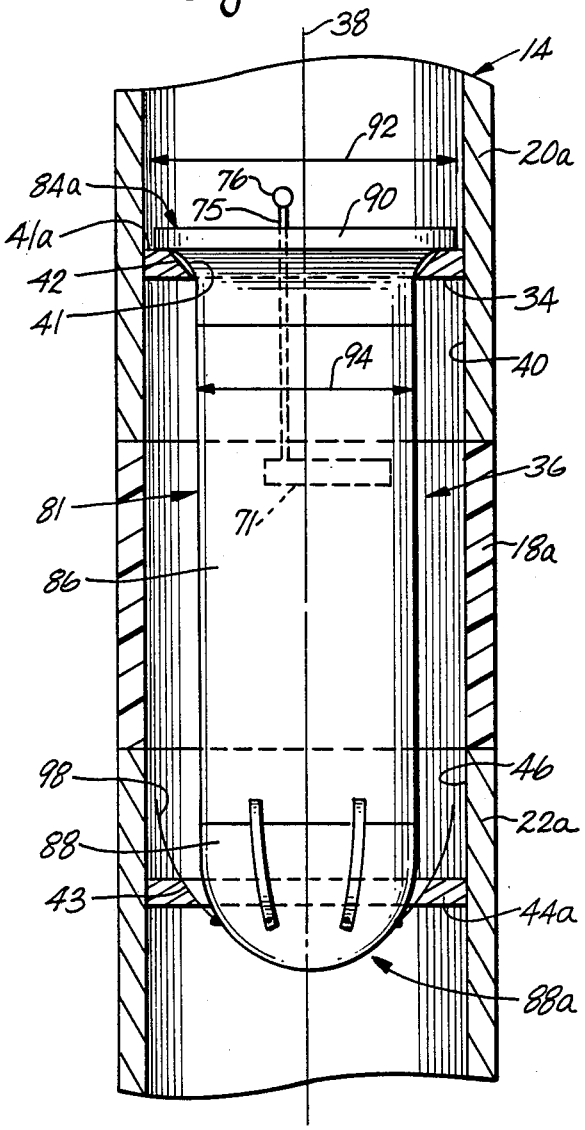
FIG. 5A is a schematic and side elevation view similar to FIG. 5 depicting an alternate embodiment of the tool and casing section.

FIG. 5A is an embodiment of the present invention which is essentially the same as FIG. 5. The same reference numerals are used in FIGS. 5 and 5A to note the same parts. The difference in the figures is at the lower conductive housing portion 88 which has a plurality of leaf springs 98 electrically and mechanically connected thereto at equally spaced intervals around the perimeter thereof. The leaf springs 98 are cantilevered from the housing portion 88 and extend outward, upward and along the side of the housing of the tool 36 towards the upper end 84*a*. Also the lower conductive ring 44*a* has its inside opening made slightly larger than ring 44 of FIG. 5 to accommodate the springs. In this manner, the electrical contact is improved between the lower conductive housing portion 88 and the inside surface 43*a* of lower ring 44*a* through the leaf spring contacts 98.

FIG. 6A depicts a specific embodiment of the switch 28 of FIG. 6. Specifically, a relay switch 28*a* has its solenoid coil 28*b* connected across the output of the microprocessor 82 (FIG. 6). Its open and closed contacts 28*c* and 28*d* are connected respectively to the upper housing portion 84 and the lower housing portion 88 and short and disconnect the housing portions.

FIG. 6B depicts a further embodiment of the switch 28 of FIG. 6 in the form of a semiconductor circuit. Specifically, the switch includes a MOSFET transistor 28*e* whose control electrode is connected to the output of microprocessor 82. The one input/output electrode of transistor 28*e* is connected to the lower housing portion 88 and the other electrode is connected to the upper housing portion 84.

FIG. 6C depicts a preferred semiconductor circuit for the switch 28. The output of the microprocessor 82 is coupled to a resistor 136 which in turn is grounded to upper housing portion 84 through resistor 138 and also is coupled to the base of NPN transistor 140. The emitter 142 of transistor 140 is grounded to the upper housing portion 84 and its collector 144 is coupled through resistor 146 to the base 148 of transistor 150. PNP transistor 150 has its emitter 152 coupled to a source of positive potential +V and its collector 154 connected through resistor 156 to a −V source of potential. The emitter 152 is also coupled through resistor 158 to the gate 160 of junction field effect transistor (JFET) 162. The JFET 162, by way of example, is a symmetric N-channel JFET having a low "on" resistance between electrodes 164 and 166 and a high "off" resistance therebetween. The electrode 164 is coupled to the lower housing portion 88 and the electrode 166 is coupled to the upper housing portion 84.

Figure 7:
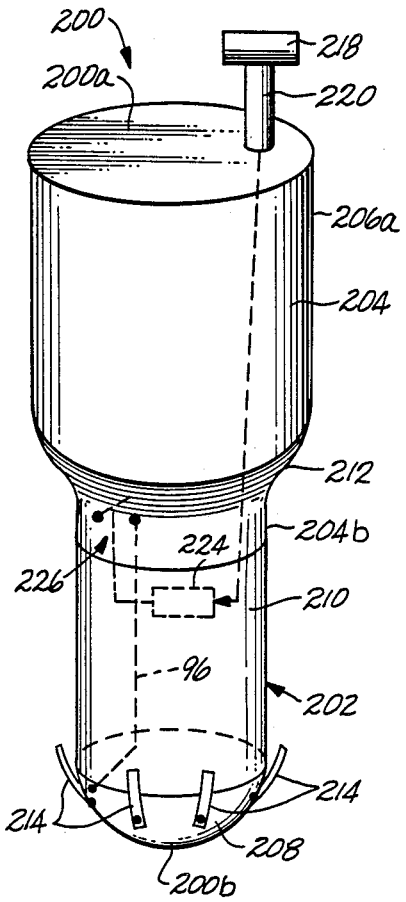
FIG. 7 is a schematic perspective view of a tool for use in the casing section of FIG. 8.

FIG. 7 depicts a further tool with a switch for switching across the nonconductive ring and embodies the present invention. The tool of FIG. 7 has an elongated and substantially bullet-shaped outer housing 202, elongated between substantially closed ends 200*a* and 200*b*. A support ring 212 is formed on the housing for landing and supporting the tool on the upper conductive ring in the casing. The ring 212 is formed in an electrically conductive upper housing portion 204 between a larger diameter cylindrical-shaped portion 204*a* and a smaller diameter cylindrical-shaped portion 204*b*. The upper housing portion 204 forms an electrically conductive contact as well as a support shoulder for landing and supporting the tool on the ring. The end 200*a* is made substantially flat for the same purpose as flat end 84*a* of tool 36 in FIG. 5.

The housing 202 also includes a lower housing portion 208 located substantially at the opposite end of the housing from the upper housing portion 204. The lower housing portion 208 is a tapered electrically conductive member having cantilevered conductive spring contacts 214, similar to the cantilevered contacts 98 of FIGS. 5A and 5, which extend upward along the side of and away from the housing of the tool.

A mast 220 supports a pressure sensor 218 on the upper end 200*a* of the housing, although as discussed above, the pressure sensor might be mounted flush on the top of the tool. Analog signals provided by pressure sensor 218 are applied to an analog-to-digital converter, a microprocessor unit 224 mounted in the housing and which is essentially the same as that indicated in 71 of FIG. 6. The output of the unit 224 is used to control the opening and closing of a switch shown schematically at 226 which corresponds to switch 28 of FIG. 1. The switch 226 has opposite sides of its open and closed contacts electrically connected to the insides of the upper housing portion 204 and the lower housing portion 208. The unit 224 and switch 226 may be configured similar to that discussed hereinabove in connection with FIG. 6. It will be appreciated that either or both the leaf spring contacts 214 and the lower housing portion 208 form an electrical contact.

An elongated tubular-shaped nonconductive housing portion 210 connects the upper and lower housing portions 204 and 208 and electrically isolates the upper and lower conductive housing portions.

As discussed above, the upper housing portion 204 and the lower housing portion 208 are each connected to upper and lower rings to the upper and lower casings, respectively.

The tool and rings on which it seats may be left in the well for the life of the well or they may be broken away and forced to the bottom of the well for future use where the cost of retrieving does not justify retrieval. If it is desired to retrieve the tool, a fishing neck or other mechanical means known in the well art may be mounted on the tool for retrieval purposes.

Figure 8:
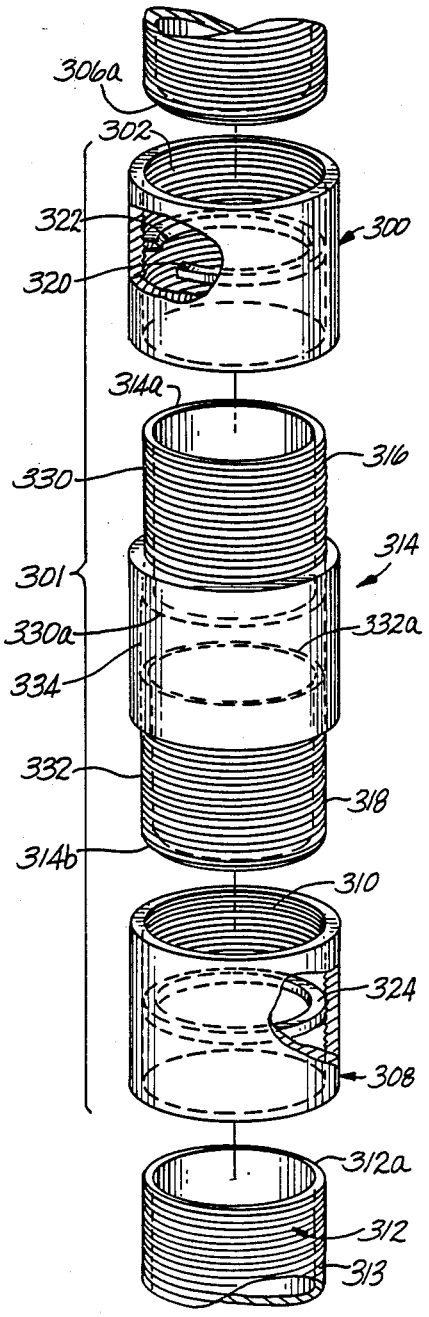
FIG. 8 is an exploded perspective view of a preferred casing section for landing the tool of FIG. 7, for separating the casing string into upper and lower casings across a nonconductive ring, and for contacting the tool of FIG. 7.

FIG. 8 depicts a preferred embodiment of a tool support and casing section 301 for introducing the nonconductive separation between upper and lower casings 304 and 312. An elongated tubular casing section or coupling 300 has internal threads 302 extending along its length. The threads 302 are adapted for coupling or interconnecting with external threads 306 of the upper casing 304. A second or lower elongated tubular casing section or coupling 308 has internal threads 310 extending along the length of its interior wall. The threads 310 are adapted for coupling or interconnecting with the external threads 313 of a lower string of casing 312. A third elongated tubular casing section 314 is adapted to provide a substantially nonconductive path to the flow of electrical current between its ends 314*a* and 314*b*. Exterior threads 316 adjacent the upper end 314*a* on casing section 314 are adapted for threading into the internal threads 302 on the casing section 306 and thereby provide a rigid mechanical and coaxial interconnection between the two. Threads 318 are provided on the casing section 314 adjacent the lower end 314*b* and are adapted for threading into the internal threads 310 of casing section 308 to thereby provide a rigid mechanical and coaxial interconnection between the sections 314 and 308.

An electrically conductive ring 320 has an outer diameter slightly smaller than the inside diameter of casing section 300 so that it can be passed down inside of section 300 and rest on the upper end 314*a* of casing section 314 when casing sections 300 and 314 have been threaded together. As a result, when the lower end 304*a* of the upper casing 304 is threaded into casing section 300, the lower end 304*a* will be tightened into good electrical and mechanical engagement with the upper surface 322 of ring 320.

A second electrically conductive ring 324 has an outside diameter slightly smaller than the internal diameter of casing section 308 so that it can also be inserted into casing section 308. When casing section 308 and lower casing 312 are connected together, the ring 324 will rest on the upper end 312*a* of the lower casing. As a result when the lower end 314*b* of casing section 314 is threaded into casing 308, the lower end 314*b* will force the ring 324 into good mechanical and electrical connection with the upper end 312*a* of the lower casing section 312.

Preferably, casing section 314 is formed of two tubular-shaped electrically conductive metal tubes 330 and 332 which are rigidly and coaxially held together by tubular-shaped nonconductive member 334. The nonconductive member 334 connects the tubular members 330 and 332 together so that their oppositely facing ends 330*a* and 332*a* are spaced apart sufficiently so as to form the desired nonconductive separation and so that minimal electrical current will flow therebetween for most normal fluids used in the casing. Preferably the member 334 is made of FIBERGLAS or KEVLAR or other material which will provide the rigidity and strength required for the casing and provide good electrical isolation between the rings. An advantage of the embodiment of FIG. 8 is that the rings 320 and 324 and the casing sections or couplings 300 and 308 are standard items available commercially from all equipment suppliers.

In the assembly, the casing sections of 301 in FIG. 8 are made up at the top of the well before the casing string is run in. Initially the lower casing section 308 is threaded onto the upper end of the lower casing 312. The conductive ring 324 is then dropped into the casing section 308 into engagement with the upper end 312*a* of the lower casing section 312. The casing section 314 is then threaded into the casing section 308 until the lower end 314*b* is in tight engagement with the ring 324, forcing the ring into good electrical contact with the end 312*a*. Next the casing section 300 is threaded onto the upper end of the casing section 314. The conductive ring 320 is then dropped into the casing section 300 against the upper end 314*a* of the casing section 314. The lower end 304*a* of the upper casing 304 is then threaded into casing section 300 until the lower end 304*a* is in good electrical and mechanical contact with the ring 322. The casing string made up as described above is then run into the well hole and is cemented in place, as is well known in the oil and gas art.

Although the lower end 306*a* of the upper casing and the upper end 312*a* of the lower casing have been described as being tightened into mechanical engagement with rings 320 and 324, respectively, one must not overtighten the ends against the rings, as the rings are preferably cast iron and may break. Therefore, in a preferred arrangement, the ends 306*a* and 312*a* are threaded into sections 300 and 308, respectively, without mechanical engagement with the rings, and electrical continuity between the ring 320 and upper casing and between the ring 324 and the lower casing is made through conductive sections 300 and 308. With such an arrangement the rings would be threaded or otherwise mechanically and electrically connected in sections 300 and 308, respectively.

When it is desired to measure the downhole pressure, a fluid will normally be in the interior passage of the casing string including the casing sections 300, 314 and 308. The fluid may be a fluid used during the fracturing of a geological formation. The tool 200 will typically be placed in a tube (not shown) that has a smaller outside diameter than the upper casing 304 with a large gate valve and the tube and the gate valve will be inserted into the upper end of the upper casing 304. The valve will then be opened to allow the tool 200 to go out of the end of the valve and sink down through the liquid until the lower end 200*b* passes through the rings 322 and 324. Where necessary the fluid pressure is increased at the top of the hole so as to force the fluid and hence the tool 200 down until the tool is wedged in good electrical contact with both of rings 322 and 324.

In the embodiment depicted in FIGS. 7 and 8, the rings 212 on the upper housing portion 204 and on the lower housing portion 208 are preferably dimensioned so that lower portion 204*b* of the upper housing portion 204 is located inside of the ring 320 while the lower housing portion 208 is positioned in the ring 324. Also the nonconductive housing portion 202 is positioned and is of sufficient length to span at least the distance between the opposing ends 330*a* and 332*a* of members 330 and 322.

Figure 9:
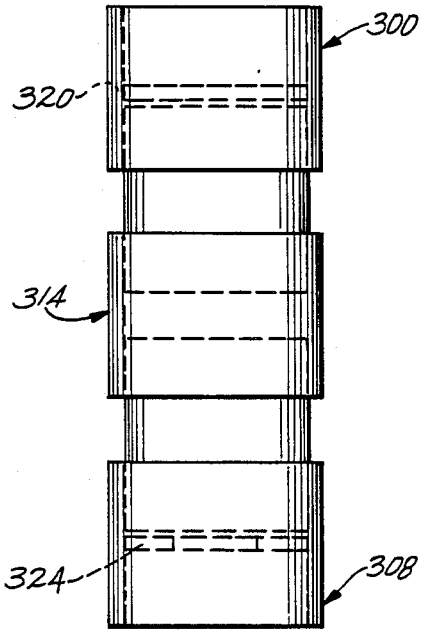
FIG. 9 is a side elevation view of the casing section 301 preassembled.

Although the parts of the casing section 301 of FIG. 8 may be provided separately and assembled at the well site during makeup, these parts are preferably preassembled and supplied as a unitary structure as depicted in FIG. 9 with the rings held in place in the structure. Also the rings can be threaded or otherwise fixed in the casing sections 300 and 308. Alternatively, the rings could be supplied separately to the structure of FIG. 9. The advantage of the preassembled structure is that the workmen at the well site only need to attach the preassembled parts into the drill string.

Figure 11:
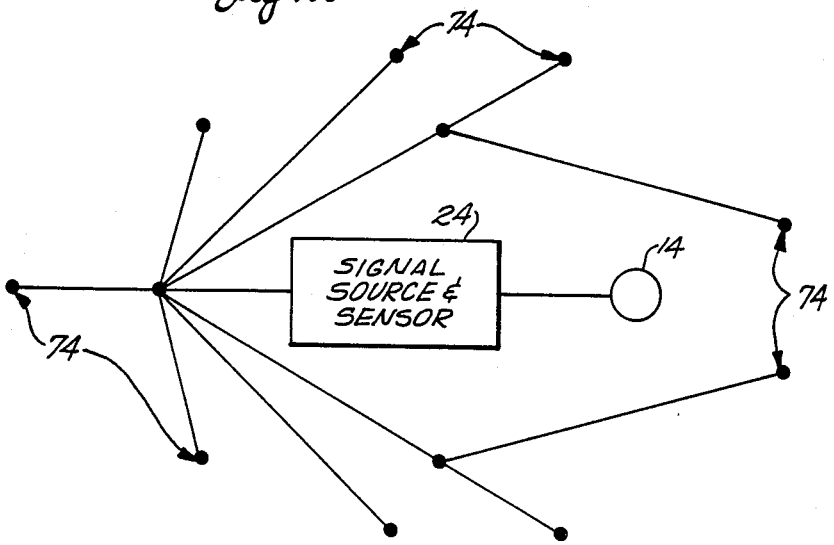
FIG. 11 is a schematic and aerial view of a well with casing depicting another example of the receiving electrode for use in the system of FIG. 1.
Figure 10:
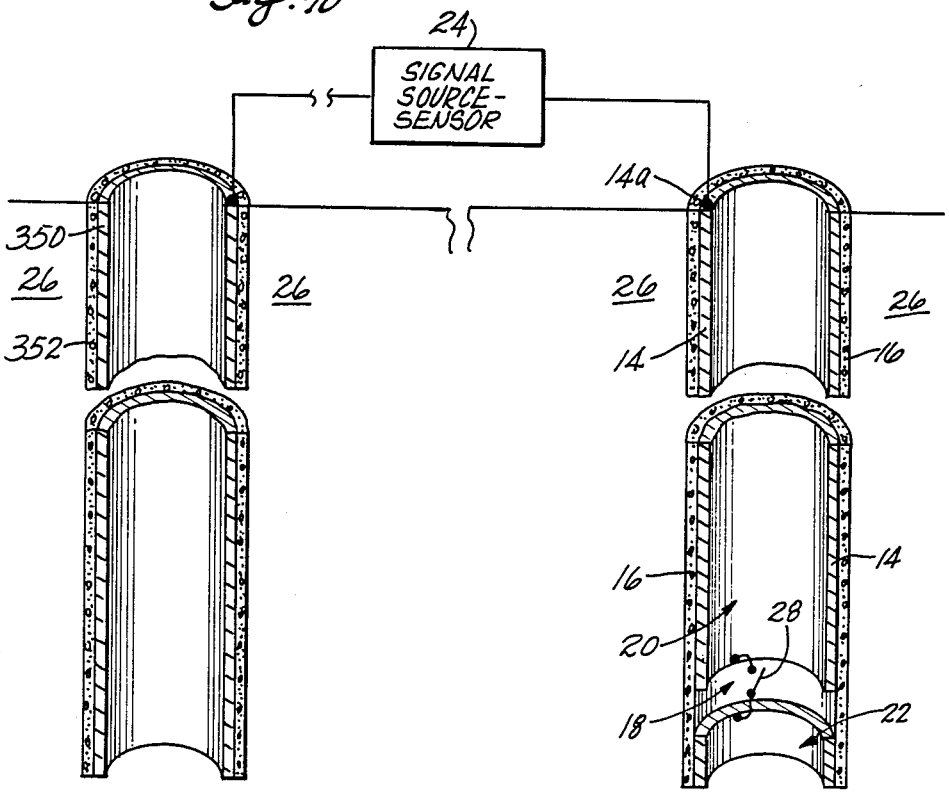
FIG. 10 is a schematic and side elevation view of the well with a casing and a switch similar to FIG. 1 and an example of one receiving electrode for use in the system of FIG. 1.

FIGS. 10 and 11 depict alternate ways in which the receiving electrode 70 of FIGS. 1–4 can be formed. In FIG. 10 the receiving electrode is the casing 350 supported in cement 352 of a well adjacent to the well in which the casing with the nonconductive ring is located. This embodiment is preferred as it provides an adequate electrical return path for electrode 70. The casing string, cement, and nonconductive ring shown on the right in FIG. 10 are essentially identical to that depicted in FIG. 1 and identical reference numerals are used to identify the corresponding parts.

FIG. 11 depicts an alternate way of forming the receiving electrode 70 and includes a plurality of long metal stakes 74, preferably made of copper, which are of sufficient length and outer surface area to provide the required electrical return path for proper sensing of the change in conductance. Preferably the stakes are separated from each other and extend at least 10 feet into the earth.

Although other techniques may be devised within the broad concept of the appended claims for running the tool downhole, locating the tool at the high impedance separation and connecting contacts on the tool to the upper and lower casings without using upper and lower rings, these techniques would generally be inferior to the technique disclosed, by way of example, herein. Such other techniques may include attaching the tool to a wireline or tubing, using such wireline or tubing to physically run the tool down the hole, to electrically determine when the tool is located at the high impedance separation, and to actuate a mechanism to fix the tool in place in the casing. However, these other techniques often require more time and cost to carry out and are less reliable than the technique disclosed by way of example herein.

Figure 12:
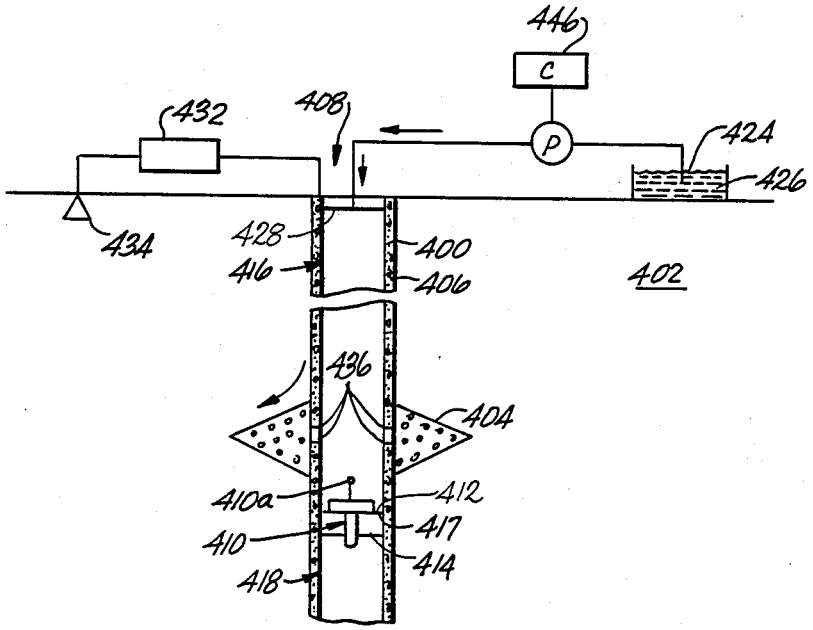
FIG. 12 is a schematic and side elevational view of a section of the earth and a well casing cemented in a borehole in the earth for use in fracturing a formation and embodying the present invention.

FIG. 12 discloses a system and method for using a tubular-shaped and electrically conductive well casing 400, which extends down through geological formation 404 in an oil or gas well for both flowing fracture fluid down to the formation from the casing at the top of the well and for communicating data representative of a parameter such as pressure in the well to the casing at the top 408 of the well. Thus the casing provides the dual function of passing the fluid from the top of the well to the formation and for communicating data pertaining to the well, uphole. The casing is cemented by cement 406 in a hole to form the structural wall of the well similar to that of FIG. 1.

A tool 410, which is essentially the same as any one of the tools disclosed in FIGS. 5, 6 or 7, which carries a switch and spaced apart electrical contacts (not shown), is inserted in the casing and is passed down through fluid to a pair of rings 412 and 414. The rings 412 and 414 are spaced apart and fixed in the casing similar to that disclosed in FIGS. 5, 5A or 8, and the shoulder on the tool 410 lands the tool on the upper ring 412. The rings 412 and 414 are connected both to the spaced apart electrical contacts of tool 410 and to an upper casing 416 and a lower casing 418 which are electrically separated by a nonconductive separation 420 similar to that described in connection with FIGS. 5, 5A and 8. The tool 410 also forms a seal with the upper ring 412 so that fluid being passed down from the upper casing is inhibited from flowing below the tool and ring 412.

A pump 422 pumps conventional fracturing fluid 424 from container 426 down through a plug 428 in the end of the casing 400. The fluid 424 is forced by pump 422 to flow through the plug, down through the passage in the casing 400 and out through perforations 436 located immediately above the tool 410 in the casing. In this manner the fracturing fluid is forced to flow into the formation 404 and either create or further expand the formation for production of hydrocarbons.

A pressure sensor 410*a* on the top of the tool senses the pressure adjacent the formation 404. A signal source and sensor 432 connected between the return electrode 434 and the casing at the top 408 of the well is similar to that described in connection with FIGS. 1–4. The signal source and sensor 432 preferably applies a substantially constant amplitude voltage AC signal to the casing and senses any changes in the current between the casing at the top 408 of the well and the earth.

The tool 410 operates a switch (not shown) in the tool for sequentially coupling and uncoupling the contacts (not shown) connected between the rings 412 and 414, causing changes in the applied signal in the casing at the top of the well representative of the pressure sensed by pressure sensor 410*a*. The signal source and sensor 432 senses the changes in applied voltage and forms a representation of the pressure data for use by an operator in controlling the pump 422 and hence the pressure or flow rate of the fracture fluid 424 being applied down the casing.

A conventional pump control unit 446 is used for controlling the pump and hence the pressure and flow of the fracture fluid into the casing.

It will be understood that the disclosed system does not transmit energy from the tool up the hole as in some prior art devices disclosed above. By way of contrast, the energy, in the form of the AC signals, is applied at the top of the well to the casing. The switch in the tool connected across the nonconductive separation changes the conductance between the upper and lower casings. The AC signal source is used to interrogate the changes in conductance and to retrieve the data represented by the changes in conductance at the top of the well.

Viewing it differently, changes in conductance across the nonconductive separation cause changes in the applied signal which are sensed and used to retrieve the data at the op of the well.

It will be understood that other types of control can be exercised over the fracture fluid. For example, propping agents may be increased, decreased or changed, chemicals may be added, decreased or changed, viscosity of the fluid may be changed, all depending on the pressure that is being displayed for the user at the top of the well. The techniques for controlling the fracture fluid are known in the art and will not be discussed in detail.

Although an exemplary embodiment of the invention has been disclosed for purposes of illustration, it will be understood that various changes, modifications and substitutions may be incorporated into such embodiment without departing from the spirit of the invention as defined by the claims appearing hereinafter.

What is claimed is:

1. A data communication system for data in a well comprising:

electrically conductive and annular casing cemented in the well and comprising a ring-shaped high impedance separation, separating the casing into an upper casing portion and lower casing portion;

means for applying an alternating current signal between the upper casing portion and the surrounding earth causing a flow of current along the casing;

a tool insertable inside of the casing to the separation and comprising switch means, for sequentially changing electrical conductance for such flow of current across the separation between the upper and lower casing portions, for causing a changing signal at the upper case representative of the data; and means coupled to the upper casing portion and responsive to the changing signal for forming a representation of the data.

2. The system as claimed in claim 1 wherein the means coupled to the upper casing comprises means for sensing the changing signal.

3. The system as claimed in claim 1 wherein the signal applying means comprises means for applying a constant current signal to the upper casing portion and wherein the means coupled senses changes in voltage.

4. The system as claimed in claim 1 wherein the signal applying means comprises means for applying a constant voltage signal between the upper casing portion and the earth surrounding the well and wherein the means coupled senses changes in such flow of current.

5. The system as claimed in claim 1 wherein the high impedance separation comprises an electrically nonconductive casing portion coupled between the upper casing portion and the lower casing portion.

6. The system as claimed in claim 5 wherein the electrically nonconductive casing portion comprises glass fibrous material.

7. The system as claimed in claim 5 wherein the electrically nonconductive casing portion comprises aromatic polyamide fibrous material.

8. The system as claimed in claim 1 wherein the high impedance separation comprises an annular spacing between the upper and lower casing portions forming an electrical discontinuity.

9. The system as claimed in claim 1 wherein the tool comprises an upper conductive portion for electrical connection with the upper casing portion, a lower conductive portion for electrical connection with the lower casing portion, and a nonconductive portion separating the upper and lower conductive portions.

10. The system as claimed in claim 9 wherein the switch means is adapted to alternately connect and disconnect the upper and lower casing portions to alternately form low and high electrical conductance paths between the upper and lower casing portions.

11. The system as claimed in claim 10 wherein the tool further comprises sensor means for sensing a parameter, the switch means being coupled to the sensor means and for alternately connecting and disconnecting the upper and lower casing portions as a function of the parameter.

12. The system as claimed in claim 11 wherein the parameter is pressure in the well.

13. The system as claimed in claim 12 wherein the sensor forms analog signals representative of the parameter and the tool further comprises an analog-to-digital converter for converting analog signals from the sensor to digital signals for control of the switch means.

14. A data communication system for data in a well comprising:

electrically conductive and annular casing cemented in the well and comprising a ring-shaped high impedance separation, separating the casing into an upper casing portion and lower casing portion;

means for applying an alternating current signal between the upper casing portion and the surrounding earth causing a flow of current along the casing;

a tool insertable inside of the casing to the separation and comprising switch means, for sequentially changing electrical conductance for such flow of current across the separation between the upper and lower casing portions, for causing a changing signal at the upper casing representative of the data; and means coupled to the upper casing portion and responsive to the changing signal for forming a representation of the data, wherein the means coupled comprises a bridge circuit coupled between such earth and the upper casing portion and means coupled to the bridge for sensing changes in electrical signal in the bridge.

15. A method for communicating data in a well, the method comprising the steps of:

providing an electrically conductive and annular casing cemented in the well and comprising a high impedance separation, electrically separating the casing into an upper casing portion and lower casing portion;

applying an alternating current signal between the upper casing portion and the surrounding earth and causing a flow of current along the casing;

inserting a tool with switch means into and moving the tool down the inside of the casing to the separation;

operating the switch means for sequentially changing electrical conductance for the flow of current between the upper and lower casing portions for causing a changing signal representative of the data; and determining from the changing signal a representation of the data.

16. The method as claimed in claim 15 comprising the step of sensing the changing signal for forming the representation of digital data.

17. The method as claimed in claim 15 wherein the step of inserting a tool comprises the step of initiating the operation of the switch means.

18. The method of claim 15 wherein the step of providing an electrically conductive annular casing further comprises the step of interposing an electrically nonconductive casing portion between the upper casing portion and the lower casing portion, thereby forming a high impedance separation in the casing.

19. The method as claimed in claim 15 wherein the step of providing an electrically conductive and annular casing comprises the step of removing a portion of the casing from the well casing, thereby forming an upper casing portion and a lower casing portion with a discontinuity therebetween.

20. The method as claimed in claim 15 wherein the step of applying an alternating current signal comprises the step of applying a constant current signal.

21. The method as claimed in claim 15 wherein the step of applying an alternating current signal comprises the step of applying a constant voltage signal.

22. The method as claimed in claim 15 wherein the step of operating the switch means comprises the step of alternately connecting and disconnecting the upper and lower casing portions to alternately form low and high impedance electrical conduction paths therebetween.

23. The method as claimed in claim 22 wherein the step of operating the switch means further comprises the step of sensing a parameter and operating the switch means in accordance with the sensed parameter.

24. The method as claimed in claim 22 wherein the step of sensing the parameter further comprises the step of sensing pressure in the well.

25. The method as claimed in claim 22 wherein the step of sensing further comprises the steps of forming analog signals representative of the parameter, converting the analog signals to digital signals and using the digital signals for control of the switch means.

26. The method as claimed in claim 15 wherein the step of inserting a tool further comprises the step of electrically contacting the tool with the upper and lower casing portions.

27. A method for communicating data in a well, the method comprising the steps of:

providing an electrically conductive and annular casing cemented in the well and comprising a high impedance separation, electrically separating the casing into an upper casing portion and lower casing portion;

applying an alternating current signal between the upper casing portion and the surrounding earth and causing a flow of current along the casing;

inserting a tool with switch means into and moving the tool down the inside of the casing to the separation;

operating the switch means, for sequentially changing electrical conductance for the flow of current between the upper and lower casing portions, for causing a changing signal representative of the data; and determining from the changing signal a representation of the data, wherein the step of determining comprises the steps of coupling a bridge circuit between earth and the upper casing portion and of sensing changes across the bridge circuit.

28. A method for communicating data in a well, the method comprising the steps of:

providing an electrically conductive and annular casing cemented in the well and comprising a high impedance separation, electrically separating the casing into an upper casing portion and lower casing portion;

applying an alternating current signal between the upper casing portion and the surrounding earth and causing a flow of current along the casing;

inserting a tool with switch means into and moving the tool down the inside of the casing to the separation;

operating the switch means, for sequentially changing electrical conductance for the flow of current between the upper and lower casing portions, for causing a changing signal representative of the data; and determining from the changing signal a representation of the data, wherein the well comprises a first well and wherein the step of applying an alternating signal comprises the step of coupling an alternating current signal source between the upper casing portion and a well casing of a second well removed from the first well.

29. A method for communicating data up to the top of a well, the steps comprising:

inserting a tool with switch means down the inside of a tubular-shaped and electrically conductive casing in the well;

connecting spaced apart contacts on the tool between upper and lower electrically conductive casing portions of the casing located on opposite sides of a high impedance separation in the casing;

operating the switch means, for sequentially changing electrical conductance for the flow of current between the upper and lower casing portions, for causing a changing signal representative of the data; and sensing the changing signal at the top of the well and forming a representation of the data,

30. Apparatus for use in combination with casing for a well for communicating digital data up the well in which the casing has a ring-shaped nonconductive separation separating the casing into an upper casing portion with a lower casing portion, the casing having an inside, the apparatus comprising:

means for applying an alternating current signal between the upper casing portion and earth causing a flow of current along the casing;

a tool insertable in and movable down the inside of the casing and comprising switch means and means for connecting the switch means across the upper and lower casing portions across the separation, the switch means sequentially changes the electrical conductance for such flow of current across the separation between the upper and lower casing portions causing a changing signal representative of the data;

means coupled to the upper casing portion and responsive to the changing signal for forming a representation of the data.

31. The apparatus as claimed in claim 30 wherein the means for applying an alternating current signal comprises a constant current source.

32. The apparatus as claimed in claim 30 wherein the means for applying an alternating current signal comprises a constant voltage source.

33. The apparatus as claimed in claim 30 wherein the means for applying an alternating current signal comprises a signal source operating below 10 hertz.

34. The apparatus as claimed in claim 30 wherein the tool comprises a first conductive portion for electrically contacting the upper casing portion, a second conductive portion for contacting the lower casing portion and a nonconductive portion separating the first conductive portion and the second conductive portion.

35. The apparatus as claimed in claim 34 wherein the nonconductive portion comprises a conductor coupled to the second conductive portion and to the switch means for alternately electrically coupling and decoupling the first conductive portion and the second conductive portion.

36. The apparatus as claimed in claim 35 wherein the second conductive portion comprises spring contacts coupled to an outside surface of the second conductive portion for electrically contacting a conductive ring in the lower casing portion.

37. The apparatus as claimed in claim 30 wherein the tool further comprises sensor means for sensing a downhole parameter, analog-to-digital converter means for converting an analog signal from the sensor means to a digital representation of the parameter and processing means for encoding the digital representation of the parameter for controlling the switch means.

38. Apparatus for use in combination with a casing for a well for communicating digital data up the well in which the casing has a ring-shaped nonconductive separation separating the casing into an upper casing portion and a lower casing portion, the casing having an inside, the apparatus comprising:

means for applying an alternating current signal between the upper casing portion and the surrounding earth causing a flow of current along the casing;

a tool insertable in and movable down the inside of the casing and comprising switch means and means for connecting the switch means across the upper and lower casing portions across the separation, the switch means sequentially changes electrical conductance for such flow of current across the separation between the upper and lower casing portions, causing a changing signal representative of the data;

means coupled to the upper casing portion and responsive to the changing signal for forming a representation of the data, wherein the representation forming means comprises a bridge circuit for sensing the changing electrical conductivity resulting from connection and disconnection of the switch means across the separation.

39. A data communication system for a well comprising:

electrically conductive and annular casing in the well and comprising a ring-shaped high impedance separation, separating the casing into an upper casing portion and a lower casing portion;

a tool insertable inside of the casing to the separation comprising switch means for creating a changing electrical conductance across the separation between the upper and lower casing portions representative of data; and means for interrogating through the upper casing with an alternating current signal the changing electrical conductance across the separation for retrieval of the data.

40. A data communication system for a well having electrically conductive and annular casing, with a high impedance separation, separating the casing into an upper casing portion and a lower casing portion, comprising:

a tool insertable inside of the casing to the separation and comprising switch means for creating a changing electrical conductance across the separation between the upper and lower casing portions representative of the data; and means for interrogating through the upper casing portion with an alternating current signal the changing electrical conductance across the separation for retrieval of the data.

41. A data communication system for a well having electrically conductive and annular casing, with a high impedance separation separating the casing into an upper casing portion and a lower casing portion, comprising:

a tool insertable inside of the casing to the separation and comprising switch means for creating a changing electrical conductance across the separation between the upper and lower casing portions representative of the data; and means for interrogating through the upper casing portion with an alternating current signal the changing electrical conductance across the separation for retrieval of the data, wherein the means for interrogating comprises a bridge circuit coupled between earth surrounding the well and the upper casing portion and means coupled to the bridge circuit for sensing changes in the bridge circuit.

42. The system as claimed in claim 41 wherein the tool comprises means for receiving a signal representative of a parameter in the well and means for controlling the pattern of operation of the switch means representative of such parameter.

43. A method for communicating data up to the top of a well, the steps comprising:

inserting a tool with switch means down the inside of a tubular-shaped and electrically conductive casing in the well;

connecting spaced apart contacts on the tool between upper and lower electrically conductive casing portions of the casing located on opposite sides of a high impedance separation in the casing;

operating the switch means for sequentially changing electrical conductance for the flow of current between the upper and lower casing portions representative of data; and interrogating through the upper casing the changing conductance with an alternating current signal for retrieving the data.

44. The method of claim 43 comprising the step of receiving a signal representative of a parameter in the well and controlling the operation of the switch means representative of the parameter.

* * * * *